US011111709B1

(12) United States Patent
Santa

(10) Patent No.: US 11,111,709 B1
(45) Date of Patent: Sep. 7, 2021

(54) ADJUSTABLE HINGE REPAIR ASSEMBLY

(71) Applicant: Jorge Santa, Pawtucket, RI (US)

(72) Inventor: Jorge Santa, Pawtucket, RI (US)

( * ) Notice: Subject to any disclaimer, the term of this patent is extended or adjusted under 35 U.S.C. 154(b) by 0 days.

(21) Appl. No.: 17/063,829

(22) Filed: Oct. 6, 2020

(51) Int. Cl.

| | |
|---|---|
| ***E05D 7/00*** | (2006.01) |
| ***E05D 5/02*** | (2006.01) |
| ***E05D 7/04*** | (2006.01) |
| ***E05D 11/10*** | (2006.01) |
| *E05D 7/10* | (2006.01) |
| *E05D 3/02* | (2006.01) |

(52) U.S. Cl.
CPC ..... *E05D 7/0009* (2013.01); *E05D 5/0223* (2013.01); *E05D 7/04* (2013.01); *E05D 11/1007* (2013.01); *E05D 3/02* (2013.01); *E05D 2007/1094* (2013.01)

(58) Field of Classification Search
CPC ..... E05D 7/0009; E05D 5/0223; E05D 5/023; E05D 5/0238; E05D 5/0246; E05D 2005/0253; E05D 2005/0261; E05D 2005/0269; E05D 7/04; E05D 7/045; E05D 7/0415; E05D 2007/0484; E05D 7/12; E05D 2007/126
USPC ..... 16/252, 253
See application file for complete search history.

(56) References Cited

U.S. PATENT DOCUMENTS 695,666 A * 3/1902 Bommer ..... E05D 5/0246 16/252
695,706 A * 3/1902 Bommer ..... E05D 5/0246 16/252
800,887 A * 10/1905 Valentine ..... E05D 5/0246 16/252
919,726 A * 4/1909 Keene et al. ..... E05D 5/0246 16/252
1,084,832 A * 1/1914 Van Valkenburg ..... E05D 7/04 16/249
1,142,582 A * 6/1915 Katzenberger ..... E05D 5/0246 16/252
2,504,749 A * 4/1950 Stepacoff ..... G02C 5/22 16/228
3,626,548 A * 12/1971 Grunert ..... E05D 3/06 16/358
4,159,557 A * 7/1979 Pittasch ..... E05D 5/08 16/237
4,185,357 A * 1/1980 Busse ..... E05D 5/08 16/236

(Continued)

*Primary Examiner* — Jeffrey O'Brien
(74) *Attorney, Agent, or Firm* — Barlow, Josephs & Holmes, Ltd.

(57) ABSTRACT

A replacement door hinge that facilitates the repair of a damaged door slab is provided. The replacement hinge includes a jamb side that is essentially the same as a conventional hinge to allow traditional mounting into the recess provided in the jamb for hinges. The slab side of the hinge is formed by a pair of opposing hinge leaves that are received on opposing sides of the door slab and include inwardly facing spikes and at least one or more countersunk screw holes to allow fastening therethrough to use screws in combination with the spikes to firmly engage the door slab. The leaves include a ratcheting retention system that engage at the edge of the door slab to allow installation onto door slabs having varying thicknesses while holding the front a back leaves together to form one unit that wraps and reinforces the door slab.

9 Claims, 3 Drawing Sheets

(56) References Cited

U.S. PATENT DOCUMENTS

| | | | | | |
|---|---|---|---|---|---|
| 4,407,044 | A * | 10/1983 | Iseki | E05D 7/04 | 16/237 |
| 4,653,144 | A * | 3/1987 | Lautenschlager, Jr. | E05D 5/0246 | 16/239 |
| 5,826,305 | A * | 10/1998 | Domenig | E05D 7/04 | 16/235 |
| 6,049,946 | A * | 4/2000 | Cress | E05D 7/04 | 16/237 |
| 6,430,778 | B1 * | 8/2002 | King | E05D 5/02 | 16/382 |
| 6,857,672 | B1 * | 2/2005 | Drew, II | E05B 15/0205 | 292/340 |
| 8,365,360 | B2 * | 2/2013 | Kunnath | A47B 95/02 | 16/415 |
| 9,140,043 | B2 * | 9/2015 | Chang | E05D 11/1064 | |
| 10,480,230 | B2 * | 11/2019 | Brun | E05D 7/0415 | |
| 2009/0139050 | A1 * | 6/2009 | Junkins | E05C 17/54 | 16/84 |
| 2018/0119473 | A1 * | 5/2018 | Jensen | E05F 5/06 | |

* cited by examiner

ADJUSTABLE HINGE REPAIR ASSEMBLY

BACKGROUND OF THE INVENTION

The present invention relates generally to a door hinge assembly. More specifically, the present invention relates to an adjustable door hinge assembly that securely fastens to a door slab of any size to reinforce and/or repair the damaged door slab thereby allowing it to be reinstalled.

Wear and tear on doors resulting from constant operation can lead to the eventual loosening of the hinge screws that extend into the door. Repeated tightening of the hinge mounting screws leads to the enlargement of the screw holes thereby eventually making it impossible to reattach the hinge in the same location on the door which corresponds with the hinge location on the door jamb. Beyond the simple wear and tear of everyday usage, there is an ever-increasing need and demand for improving the security and structural integrity of entry doors. This demand is being driven by the repeated occurrences of unauthorized and forced entry through entry doors that also result in damage to the hinge regions of the door slab.

The hinges present a source of weakness in that hinges are attached to a door jamb and to the door using only short screws having small diameters. When the hinge region of a door is subjected to the kicking force of an intruder, a failure will generally occur as these screws will pull free of the door jamb and/or door slab. Further, once such damage has been done as the result of a forced entry it is often difficult, if not impossible to simply reattach the old hinges to the door slab.

Improvements to the reinforcement of the door structure have with few exceptions been directed at improvements to the jamb in the region adjacent the locking mechanism of the door. Early improvements were directed to enlarging a striker plate for installation on the outer surface of the doorjamb. While these developments allowed for an applied force to be distributed over a greater area, the resistance to the force still depends on the strength of a relatively weak section of the door at the hinge points.

There are known various structures for securing hinges to doors and door frames of both wood and metal. In wooden doors, as stated above, it is not uncommon for the hinge to become loose after prolonged use. The screws used to hold the hinge in place are generally pulled free of the door or door jamb leaving larger holes than originally created by the screws. Therefore, to reattach the hinge, the door slab or door jamb needs to be repaired in order to reattach the hinge. In some instances, the hinge cannot be located in its original position because of damage to the door and jamb. In these cases, the hinge is relocated and attached to a new portion on the door. The door slab and jamb then must be cut out in the new location in order to accommodate the thickness of the hinge to be located thereon.

Several hinge reinforcement devices have been disclosed in the prior art. For example, a horizontally-adjustable door hinge is disclosed that uses a hinge structure having a back plate which is attached to an elongated plate that fits along the vertical edge of the door frame to facilitate the horizontal adjustment of the door. The hinge is then attached to these plates to adjust the alignment. This type of structure cannot be used as a repair kit, however, because the additional thickness of the plates combined with the original hinge would require more space than is available at the door slab margin and render the door non-functional.

Another adjustable hinge mount is disclosed for use on hollow metal or wood doors and door frames. A reinforcing plate or flat bracket member must be inserted into the door slab. Such a device is only usable on hollow doors since there is a need to internally secure the bracket. In use, one would cut a pocket in the door slab and such a procedure is relatively complex especially for the non-professional.

There is therefore a need for a hinge repair and reinforcing kit that can be quickly mounted to the damaged hinge area of a door thereby salvaging the door and limiting the instances where the door must be discarded. There is a further need for a modular hinge repair kit that utilizes an adjustable bracket that is mounted directly to and wraps around a damaged door and includes a corresponding hinge mounting plate that allows the door slab to be securely reinstalled into the jamb opening. There is still a further need for a secure hinge repair kit that is modular to facilitate ease of installation while also providing security yet still installs within the margin available between the door slab and jamb to eliminate the need for substantial modifications prior to installation.

BRIEF SUMMARY OF THE INVENTION

In this regard, the present invention provides for a replacement door hinge that facilitates the repair of a damaged door slab and reduces the need for replacement of door slabs that have been damaged or split in the hinge area. The replacement hinge preferably includes a jamb side that is essentially the same as a conventional hinge to allow traditional mounting into the recess provided in the jamb for hinges. The slab side of the hinge is formed by a pair of opposing hinge leaves that are received on opposing sides of the door slab front and rear face. The opposing leaves include inwardly facing spikes to engage the door surface and at least one or more countersunk screw holes to allow fastening therethrough to use screws in combination with the spikes to firmly engage the door slab. One of of the leaves has a serrated structure that wraps the door slab at the butt edge and engages with a ratcheting retention system to allow the two leaves to be installed onto door slabs having varying thicknesses while holding the front and back leaves together to form one unit that wraps and reinforces the door slab.

The unique construction of the replacement door hinge of the present invention allows ease of installation despite the skill or knowledge of the user. Further, the replacement hinge provides a strong and reliable reinforcement that allows a damaged door slab to be salvaged rather than necessitating a repair. This arrangement provides reinforcing of the door slab as well as an installation that closely mirrors the existing hinge assembly allowing smooth operation and installation without the need for significant modification of the door slab and jamb as was required of typical repair systems in the prior art. Further, the present replacement door hinge fits within the existing margin provided between the door slab and the jamb thereby eliminating the need for the removal of additional material to allow installation.

It is therefore an object of the present invention to provide a hinge repair and reinforcing kit that can be quickly mounted to the damaged hinge area of a door thereby salvaging the door and limiting the instances where the door must be discarded. It is a further object of the present invention to provide a modular hinge repair kit that utilizes an adjustable bracket that is mounted directly to and wraps around a damaged door and includes a corresponding hinge mounting plate that allows the door slab to be securely reinstalled into the jamb opening. It is still a further object of the present invention to provide a secure hinge repair kit that is modular to facilitate ease of installation while also providing security yet still installs within the margin available between the door slab and jamb to eliminate the need for substantial modifications prior to installation.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
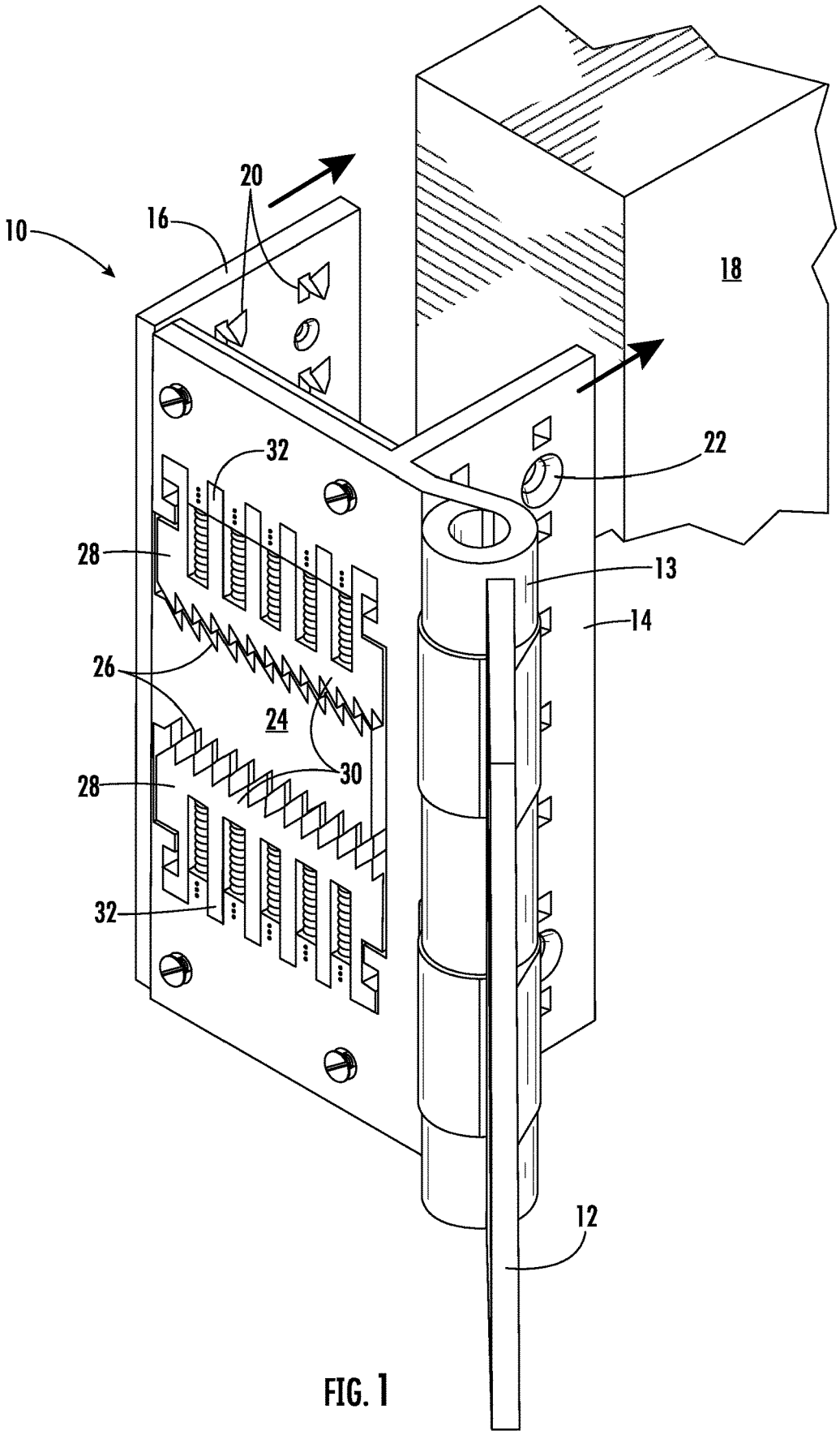
FIG. 1 is a front perspective view of the door hinge assembly of the present invention.

Now referring to the drawings, a modular replacement door hinge is disclosed to facilitate the repair of a damaged door slab thereby reducing the need for replacement of door slabs that have been damaged or split in the hinge area.

Turning now to FIG. 1 the replacement door hinge 10 can be seen to preferably include a jamb leaf 12 side that is essentially the same as a conventional door hinge to allow traditional mounting into the recess provided in the jamb for hinges. A barrel 13 is shown as the engagement point between the door slab portion of the hinge and the jamb portion of the hinge and receives a hinge pin therein to allow rotational operation of the two hinge portions and thereby swinging operation of the door slab 18 relative to the door jamb. It should be appreciated that while the barrel is shown in the drawings as being formed on one leaf 14, it can be appreciated by one skilled in the art that the barrel 13 could instead be formed on leaf 16 and still fall within the scope of the present invention.

The slab side of the hinge 10 is formed by a pair of opposing hinge leaves 14, 16 that are received on opposing sides of the door slab 18 front and rear face. As will be described in detail below, the hinge 10 utilizes the two opposing hinge leaves 14, 16 in a securely adjustable manner to firmly engage with the door slab for a range of door slab 18 thicknesses. This allows the hinge 10 to be utilized for repair on a range of different door sizes and thicknesses to replace an original hinge where the door slab 18 has split or the mounting screw holes have been stripped or enlarged to a point where the traditional screws no longer serve to hold the original hinge and door slab 18 in firm connection.

It can be appreciated that the door hinge 10 of the present invention may be formed from any material known in the art, including, but not limited to: steel, iron, brass, aluminum, and the like. Further, the door hinge 10 may be finished using any of the finishes known to provide a decorative appearance and such finishes are not considered limiting or as falling within the scope of this disclosure.

Figure 2:
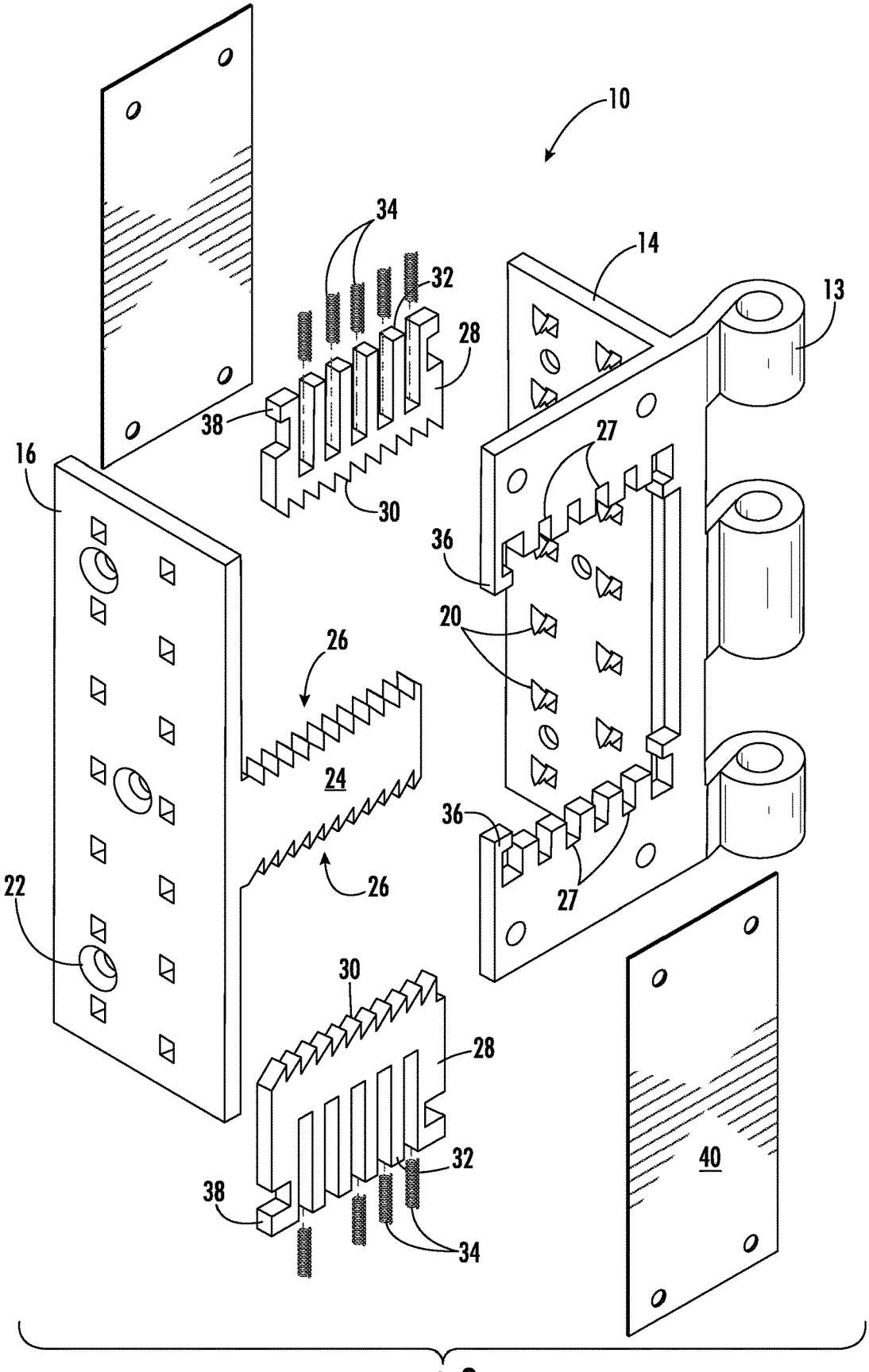
FIG. 2 is a front, exploded perspective view of the door hinge assembly of the present invention.

Now viewing FIG. 2 in combination with FIG. 1, the door hinge 10 is seen to include two opposing leaves 14, 16 that cooperate to engage the door slab 18 therebetween. The opposing leaves 14, 16 may optionally include inwardly facing spikes 20 to firmly engage the door surface and may also optionally include at least one or more countersunk screw holes 22 to allow fastening therethrough. In this manner the opposing leaves 14, 16 may be affixed to the door slab 18 using the spikes 20, the screws 22 or a combination thereof to firmly engage the door slab.

One of the leaves 16 has an arm 24 extending at approximately 90 degrees therefrom in a manner that provides for the arm to extend from the leaf 16 around the butt edge of the door slab 18. The arm 24 has a serrated sawtooth structure 26 on a top and bottom edge thereof. The other leaf 14 has a ratcheting retention system that will be described in more detail below that receives and engages with the serrated sawtooth structure 26 on the first leaf 16 to allow the two leaves 14, 16 to be installed onto door slabs having varying thicknesses while holding the front and back leaves together to form one unit that wraps and reinforces the door slab.

The second leaf 14 is shown to include a ratcheting mechanism formed therein to receive and retain the arm 24 on the first leaf 16. The leaf 14 has guides 27 formed therein that serve to slidably receive and guide the inward and outward motion of at least one ratchet pawl 28. The ratchet pawl 28 also includes a complementary sawtooth structure 30 that is configured and arranged to engage with the corresponding sawtooth structure 26 on the arm 24. Further, the ratchet pawl 28 has fingers 32 that are slidably received into the guides 27 thereby allowing a smooth in and out motion of the ratchet pawl 28. Preferably there is at least one spring 34 positioned in at least one of the guides 27 that exerts spring pressure against the corresponding finger 32 to spring bias the ratchet pawl 28 into engagement with the sawtooth 26 on the arm 24 when the hinge is fully assembled. Corresponding stop shoulders 36, 38 are provided on at least one of the pawl 28 fingers 32 and in the guides 27 to engage with one another and prevent the ratchet pawl 28 from extending too far and falling out of position when the arm 24 is not positioned therein.

It should be appreciated that the present invention illustrates a top and bottom ratchet pawl 28 in opposing relation to the arm 24. IT is within the scope of this invention to fashion the arm 24 to include only sawtooth features 26 on one side thereof and utilize a single ratchet pawl 28 rather than two as shown and illustrated.

One or more trim plates 40 may be provided and fastened to the front and rear of the second leaf 14 adjacent the ratcheting mechanism. The trim plates may be provided to close the assembly and to retain all the pieces therein thereby preventing them from being dislodged and making the ratcheting assembly secure.

Figure 3:
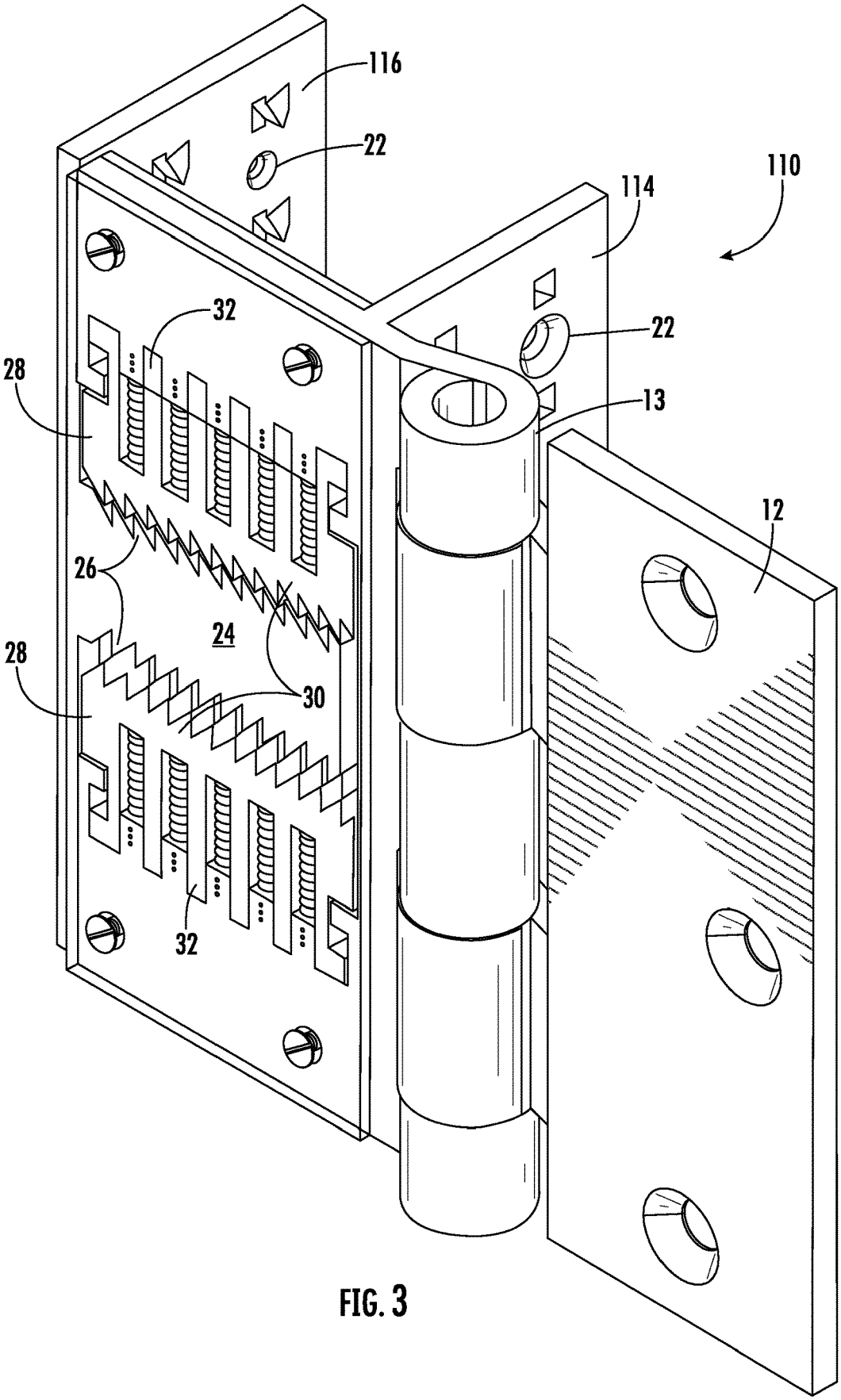
FIG. 3 is a front perspective view of an alternate configuration of the door hinge assembly of the present invention.

As can be seen in FIG. 3, the alternately arranged door hinge 110 is seen to include two opposing leaves 114, 116 that cooperate to engage the door slab 18 therebetween. The opposing leaves 114, 116 preferably do not include inwardly facing spikes as described above but instead employ at least one or more countersunk screw holes 22 to allow fastening therethrough. In this manner the opposing leaves 114, 116 may be affixed to the door slab 18 using the screws 22 or a combination thereof to firmly engage the door slab.

In operation, the hinge leaves 14, 16 are positioned to the front and rear faces of the door slab. This may be done while both leaves are fully separated or with arm 24 partially engaged into the ratcheting mechanism. When the hinge leaves are fully received onto the door, the hinge leaves are pressed fully together such that the spikes 20 engage the door and optionally screws are installed to hold the leaves 14, 16 in engagement with the slab. During this installation process the arm 24 is slidably inserted into the ratcheting mechanism and the ratchet pawl 28 engaged with the sawtooth features 26 on the arm such that the hinge leaves 14, 16 are fully engages with one another about the butt edge of the door slab. With the hinge installed onto the door slab, the door can be remounted by utilizing the conventional leaf 12 of the hinge to hang the door slab onto the jamb.

The unique construction of the replacement door hinge of the present invention allows ease of installation despite the skill or knowledge of the user. Further, the replacement hinge provides a strong and reliable reinforcement that allows a damaged door slab to be salvaged rather than necessitating a repair. This arrangement provides reinforcing of the door slab as well as an installation that closely mirrors the existing hinge assembly allowing smooth operation and installation without the need for significant modification of the door slab and jamb as was required of typical repair systems in the prior art. Further, the present replacement door hinge fits within the existing margin provided between the slab and the door thereby eliminating the need for the removal of additional material to allow installation.

It can therefore be seen that the present invention provides a hinge repair and reinforcing kit that can be quickly mounted to the damaged hinge area of a door thereby salvaging the door and limiting the instances where the door must be discarded. Further, the present disclosure provides a modular hinge repair kit that utilizes an adjustable bracket that is mounted directly to and wraps around a damaged door and includes a corresponding hinge mounting plate that allows the door slab to be securely reinstalled into the jamb opening. Still further, the present invention provides a secure hinge repair kit that is modular to facilitate ease of installation while also providing security yet still installs within the margin available between the door slab and jamb to eliminate the need for substantial modifications prior to installation.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A hinge assembly, comprising:

a first hinge leaf and a second hinge leaf;

an arm extending from a rear edge of said first hinge leaf at approximately 90 degrees thereto, said arm having a top and bottom edge with first sawtooth projections extending from one of said top and bottom edges;

a ratcheting assembly extending from a rear edge of said second hinge leaf at approximately 90 degrees thereto, said ratcheting assembly including a first ratchet pawl positioned therein, said ratcheting assembly receiving said arm therein, said first ratchet pawl engaging said first sawtooth projection on said arm; and a hinge barrel formed on one of said first and second hinge leaves to rotatably engage a conventional hinge leaf;

wherein the first hinge leaf, the second hinge leaf, the arm, and the ratcheting assembly are configured to be wrapped around a butt edge of a door slab, the ratcheting assembly configured to accommodate varying thicknesses of the door slab.

2. The hinge assembly of claim 1, further comprising: at least one spring within said ratchet assembly to spring bias said first ratchet pawl into engagement with said arm.

3. The hinge assembly of claim 2, further comprising: one or more trim plates to enclose said ratchet assembly.

4. The hinge assembly of claim 1, further comprising: inwardly facing spikes positioned on an inner face of each of said first and second hinge leaves.

5. The hinge assembly of claim 1, further comprising: screw mounting holes through faces of said first and second hinge leaves.

6. The hinge assembly of claim 1, further comprising:

said first sawtooth projections extending from said top edge of said arm;

second sawtooth projections extending from said bottom edge of said arm; and said first ratchet pawl engaging said first sawtooth projections on said top edge of said arm and a second ratchet pawl engaging said sawtooth projections on said bottom edge of said arm.

7. The hinge assembly of claim 6, further comprising: springs within said ratchet assembly to spring bias said first and second ratchet pawls into engagement with said arm.

8. The hinge assembly of claim 7, further comprising: one or more trim plates to enclose said ratchet assembly.

9. The hinge assembly of claim 1, wherein said hinge assembly is formed using materials selected from the group consisting of: steel, iron, brass, aluminum, and combinations thereof.

* * * * *